US007178343B2

(12) United States Patent
Linder

(10) Patent No.: US 7,178,343 B2
(45) Date of Patent: Feb. 20, 2007

(54) COMPACT THERMOELECTRIC WINE COOLER AND HUMIDOR

(75) Inventor: Nathan W. Linder, West Covina, CA (US)

(73) Assignee: Innovative Displayworks, Inc., San Dimas, CA (US)

( * ) Notice: Subject to any disclaimer, the term of this patent is extended or adjusted under 35 U.S.C. 154(b) by 156 days.

(21) Appl. No.: 11/087,141

(22) Filed: Mar. 23, 2005

(65) Prior Publication Data

US 2006/0213206 A1 Sep. 28, 2006

(51) Int. Cl.
*F25B 21/02* (2006.01)

(52) U.S. Cl. ..... 62/3.6; 62/457.8

(58) Field of Classification Search ..... 62/3.6, 62/371, 457.1, 457.3, 457.4, 457.8
See application file for complete search history.

(56) References Cited

U.S. PATENT DOCUMENTS 583,652 A 6/1897 Mulligan
3,263,806 A * 8/1966 Ring ..... 206/427
3,401,535 A * 9/1968 Palmer ..... 62/457.5
4,119,248 A * 10/1978 Butler et al. ..... 224/148.3
4,164,851 A 8/1979 Bryant
4,266,407 A * 5/1981 Gibson ..... 62/371
4,281,520 A * 8/1981 Norwood ..... 62/372
4,481,792 A * 11/1984 Groeger et al. ..... 62/457.5
4,531,381 A 7/1985 Toro et al.
4,580,412 A * 4/1986 Wells ..... 62/372
4,628,705 A * 12/1986 Nave ..... 62/457.5
4,671,070 A 6/1987 Rudick
4,866,945 A 9/1989 Bender et al.
4,913,713 A 4/1990 Bender et al.

(Continued)

FOREIGN PATENT DOCUMENTS

GB 2301172 A * 11/1996

OTHER PUBLICATIONS

Website printout: www.compactappliance.com; "Max Fridge 7 Bottle Portable Wine and Beverage Cooler with LED Display"; 2 pages; May 9, 2005.

(Continued)

*Primary Examiner*—Mohammad M. Ali
(74) *Attorney, Agent, or Firm*—Stetina Brunda Garred & Brucker

(57) ABSTRACT

A wine cooler is provided which may also function as a humidor. The wine cooler is embodied in a cabinet preferably made from wood. The cabinet includes a base and a lid. The wine cooler further includes a bottle tray positioned within an upper area of the base. The bottle tray includes a plurality of semicircular recesses formed in the tray, each of which are adapted to receive a wine bottle. A plurality of circulation slots are disposed through the bottle tray for assisting with air circulation within the wine cooler. The wine cooler further includes a thermoelectric cooling system comprising at least one thermoelectric couple, each thermoelectric couple having a cold and hot junction, wherein the cold junction is attached to the lower surface of the bottle tray and a first heat sink is attached to the hot junction, and wherein the at least one thermoelectric couple is adapted to be powered by a 12VDC source.

19 Claims, 4 Drawing Sheets

U.S. PATENT DOCUMENTS

| | | | | |
|---|---|---|---|---|
| 5,007,250 | A * | 4/1991 | Musielak | 62/372 |
| 5,101,642 | A * | 4/1992 | Alexandrov | 62/371 |
| 6,269,653 | B1 | 8/2001 | Katusa | |
| D475,068 | S | 5/2003 | Wang | |
| 6,658,859 | B2 | 12/2003 | Phelps et al. | |
| 6,672,092 | B2 | 1/2004 | Ruiz et al. | |
| D493,181 | S | 7/2004 | Kehoe | |

OTHER PUBLICATIONS

Website printout: www.beveragefactory.com; "Vinotemp VT6V 6 Bottle Vertical Countertop Wine Cellar"; 3 pages; May 9, 2005.

Website printout: www.beveragefactory.com; "Vinotemp VT6H 6 Bottle Horizontal Countertop Wine Cellar"; 3 pages; May 9, 2005.

* cited by examiner

COMPACT THERMOELECTRIC WINE COOLER AND HUMIDOR

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Field of the Invention

The present invention relates to compact wine coolers. In particular, the present invention relates to compact wine coolers adapted for (1) maintaining the temperature of a small collection of wine bottles at a preferred temperature, while also simultaneously (2) maintaining a proper humidity level within the storage device, (3) providing a preferred horizontal storage orientation for the bottles, and also (4) providing a completely dark environment which keeps the bottles from exposure to harmful light.

2. Background of the Invention

The art of storing wine has been studied and practiced since wine was invented. Four of the most important factors to consider when storing wine are: (1) maintaining the optimal storage temperature, (2) maintaining an optimal storage humidity, (3) keeping the wine from direct exposure to sunlight or artificially generated light, and (4) storing the bottles in a horizontal orientation.

It is generally accepted that wine should normally be stored between 50–60° F., although a range of 45–65° F. is considered acceptable and the most easily maintained by the normal collector. The optimal temperature for storing wine is 55° F. A lower, colder temperature causes the aging process to slow down, preventing the wine from aging properly. A higher, warmer temperature causes premature aging. If wine is kept over 85° F. for even a single month, irreparable damage is done to it. What hurts wine the most is temperature fluctuation. Along these lines, a steady storage at 65° F. is regarded as being better than storage which fluctuates from 45° F. to 65° F. and then back again 45° F. every day. One of the effects of this cycle in temperature is that the cork is pulled in and out via intrabottle pressure changes that can allow air to get in to the wine, which is detrimental. Also, cold temperatures can be just as bad. For instance, storing wine or champagne in a refrigerator for too long tends to compromise the redeeming qualities of the beverage.

The second factor to monitor during wine storage is humidity. Preferably a medium-high humidity (about 60–75%) is preferred. Although humidity fluctuations are not as bad for wine as temperature fluctuations, humidity still can impact the wine. Low humidity dries out the cork, even if the bottle is properly stored on its side in order to keep the cork moist. If the cork dries out, oxygen can migrate into the wine bottle—a rare occurrence, but still something to be monitored. Also, high humidity tends to destroy the labels which are used verify the winery from which the wine was made and the date the wine was bottled, information of which is quite important to most wine aficionados.

Also, the wine bottles should be kept away from direct exposure to sunlight or artificial light, since the sun and/or light can also cause the wine to deteriorate prematurely. Therefore, it is ideal to have the wine stored in complete darkness. And finally, as already mentioned, the bottles should be stored on their sides in a horizontally oriented manner so that the cork does not dry out. Therefore, in general, a storage environment with a constant temperature between 50–60° F. and a medium-high humidity (about 60–75%) that always stays dark and of which stores the bottles horizontally is the optimal wine storage environment.

To accomplish the aforementioned storage requirements, most serious wine aficionados have traditionally stored their wine bottles in wine cellars which are designed to meet the temperature, humidity, darkness and horizontal storage requirements. However, most casual wine consumers do not have the financial resources to own their own personal wine cellar, much less keep the cellar stocked with expensive vintage high quality wines. Instead, most wine consumers tend to focus on the quality of the wine they have purchased or acquired, while being somewhat unsophisticated in their storage techniques.

For example, typically, the average wine consumer either utilizes a standard simple wine rack in their home (e.g., lattice type structure) which is designed to store from just a few bottles to numerous bottles (i.e. a couple dozen). Most wine racks merely provide a structural device which assists one in efficiently storing the wine bottled in the recommended horizontal orientation in a safe yet accessible spot within the home, such as the kitchen, dining room, lounge or other suitable areas of the home. However, the other critical wine storage parameters typically are not met. In this common scenario, the wine is usually stored at the temperature of the home, which averages around 72° F., while also fluctuating from daytime to evening 10–15° F. The wine racks further typically do not provide any feature to control humidity. Moreover, most common wine racks tend to be open-styled display racks which prominently display the bottles of wine. Unfortunately, such common design for wine racks does not provide a continuous dark storage environment which is recommended.

There are prior art wine cooling devices, such as mini-refrigerators, which have been around for several years. These mini-refrigerators typically use the same mechanical components as larger conventional refrigerators, including evaporators, compressors and condensers. A drawback with such mini-refrigerators is that they typically are not as compact as one would wish, they tend to be noisy, and they are not power efficient. Furthermore, compressors and their motors are both subject to wear and freon-filled coils are subject to leakage and costly repairs. Finally, the aforementioned conventional mini-refrigerators tend to have very little aesthetic appeal.

Recently, compact wine (and/or beverage) coolers or refrigerators which utilize thermoelectric cooling systems have become quite popular. Thermoelectric (T.E.) refrigeration uses a principle called the "PELTIER" effect to pump heat electronically. The advantages of thermoelectric cooling devices or "couples" are numerous. For instance, thermoelectric devices are smaller than the conventional cooling components (e.g. evaporators, compressors, and condensers), and as a result, save space and weight. Very little space is required by thermoelectric cooling systems. For example, some thermoelectric modules may only be the size of a penny or matchbook. Moreover, T.E. devices are even considered to be more reliable than conventional cooling systems, having a forty year proven track record in military, aerospace, laboratory, and now consumer applications. Additionally, thermoelectric devices are environmentally safer than condition refrigerator systems. For instance, the system contains no hazardous gases.

As a result of the advantages thermoelectric cooling devices present, recently there have been numerous compact thermoelectric wine coolers and/or beverages refrigerators offered to the public. Although many of them are adapted to provide ideal storage temperatures, many still underemphasize the need to maintain the proper humidity, darkness and even horizontal orientation storage requirements. For instance, a popular style of a thermoelectric cooler may store anywhere from a few bottles to over two dozen bottles in a square or rectangular cabinet in the proper horizontal orientations. Some of these cabinets have glass see-through front doors so that the bottles can be prominently displayed. Other, small and compact wine coolers or refrigerators only accommodate the wine bottles in a standing orientation. Furthermore, humidity control features appear to not be readily available on wine coolers. Moreover, most wine coolers tend to not have any redeeming qualities with respect to aesthetic design. Instead they tend to look like small appliances, such as mini-refrigerators.

There is an apparent need for a compact wine cooler which meets all the basic storage requirements (i.e., proper temperature, humidity, darkness, and horizontally stored orientation). Ideally, the wine cooler device would be compact such that it takes up minimal space in the home or place of use. For instance, it would be ideal to provide a wine cooler device which has a low-profile which can fit on a kitchen counter underneath overhead cabinets, or be positioned atop a buffet cabinet or a table. Moreover, not only should the proposed wine cooler meet these aforementioned functional objectives, it should also be designed to have some redeeming aesthetic characteristics which would allow one to integrate the wine cooler into a designer kitchen, dining room, lounge or any other suitable area in the home. That is to say, it is important to provide a compact wine cooling and humidifying device that is capable of properly storing a few expensive bottles of wine in optimal conditions, while at the same time providing an appliance that does not look like or have the noise of a conventional mini-refrigerator.

BRIEF SUMMARY OF THE INVENTION

The present invention is intended to overcome and solve the aforementioned problems commonly encountered with wine storage and compact wine coolers. Furthermore, the present invention provides better performance characteristics than any previously known or published approaches.

According to an aspect of the present invention, an exemplary thermoelectric wine cooler and humidor is provided. The wine cooler and humidor supports all the basic requirements for storing wine, including proper: (1) temperature, (2) humidity, (3) darkness, and (4) a horizontally stored orientation. The present invention wine cooler is designed to be compact, having a low-profile, such that it takes up minimal space in the home or place of use. The present invention wine cooler is designed such that it can store a plurality of bottles (preferably three). As a result of its compact design, the present invention wine cooler can easily fit on a kitchen counter underneath overhead cabinets, or be positioned atop a buffet cabinet or a table. The exterior of the present invention wine cooler and humidor looks similar to that of a cigar humidor, thus, besides its functional attributes, it is also designed to have some aesthetic characteristics which allow it to be integrated into a designer kitchen, dining room, lounge or any other suitable area in the home or place of use.

According to the present invention, the wine cooler and humidifier preferably comprises a rectangular cabinet which includes a base having four vertically oriented sidewalls, four vertically oriented legs, and a horizontally oriented bottom side. The legs define four corners of the cabinet, each of the sidewalls are joined between a pair of legs, and the bottom side is attached to lower edges of the four sidewalls and to sides of the legs and positioned above a supporting surface. The present invention wine cooler and humidor further includes a lid hingedly attached to an upper portion of the base. In a preferred embodiment, the lid includes four side edges, a topside, and may also have an arcuate convex shape.

According to another aspect of the present invention, a bottle tray having an upper and lower surface, is positioned within an upper area defined by the base in a generally horizontal manner. The bottle tray includes a first plurality of generally semicircular recesses formed in the tray, each of which are adapted to receive a wine bottle. The recesses are positioned laterally next to each other, and a plurality of longitudinal circulation slots may be disposed through the bottle tray, wherein the plurality of slots are adapted for assisting with air circulation within the wine cooler apparatus.

According to another aspect of the present invention, a thermoelectric cooling system is provided comprising of at least one thermoelectric couple, each thermoelectric couple having a cold and hot junction, wherein the cold junction is attached to the lower surface of the bottle tray and a first heat sink is attached to the hot junction. Preferably, the at least one thermoelectric couple is adapted to be powered by a 12VDC source, which may be powered by 110 VAC or 120 VAC with the use of a proper electrical converter. Furthermore, the bottle tray acts as a cold pan which functions as a second heat sink which absorbs heat from the bottles and expels the heat from the hot junction.

According to yet another aspect of the present invention, at least one circulating fan may be provided for extracting heat from the first heat sink and directing the heat outside of the cabinet through optional vents disposed through one of the sidewalls or the bottom side of the base.

Additionally, other aspects of the present invention may include a 12 VDC converter for receiving 110 or 120 AC and converting the same to 12 VDC; a temperature controller for maintaining a desired temperature within the wine cooler; an ON/OFF switch; a digital temperature readout device; and a digital hygrometer readout device.

And yet another aspect of the present invention includes a sliding cabinet drawer adapted to be positioned within a lower area of the base in a generally horizontal storage arrangement, and wherein the drawer is adapted to be pulled out from a drawer opening disposed through a sidewall of the base.

Another embodiment of the present invention may further include a humidifier device. Also, it is preferred that the cabinet is constructed from wood which is ideal for absorbing and releasing humidity, similar to that of a cigar humidor.

According to another aspect of the present invention, the bottle tray includes three recesses for receiving three regular sized wine bottles. Moreover, in one embodiment of the bottle tray, the longitudinal circulation slots are positioned on each side of the first plurality of semicircular recesses. While in another embodiment of the bottle tray, the longitudinal circulation slots are positioned within the first plurality of semicircular recesses. Moreover, in the latter tray embodiment, each one of the first plurality of semicircular recesses includes a plurality of radially concentric ribs protruding upwardly from each recess, wherein the plurality of ribs are adapted for supporting a wine bottle.

In another aspect of the present invention, a pair of handles may be attached to a pair the sidewalls of the base which oppose each other. Also, a lid interior panel may be disposed within an underside of the lid. The interior panel may include a second plurality of generally semicircular recesses formed in the lid which are adapted to receive a wine bottle when the lid is closed. Also, the topside of the lid may have an arcuate convex shape for providing extra clearance if desired.

Other exemplary embodiments and advantages of the present invention may be ascertained by reviewing the present disclosure and the accompanying drawings.

BRIEF DESCRIPTION OF THE DRAWINGS

The present invention is further described in the detailed description that follows, by reference to the noted drawings by way of non-limiting examples of preferred embodiments of the present invention, in which like reference numerals represent similar parts throughout several views of the drawings, and in which.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Structural Details of an Exemplary Wine Cooler and Humidor

Figure 1:
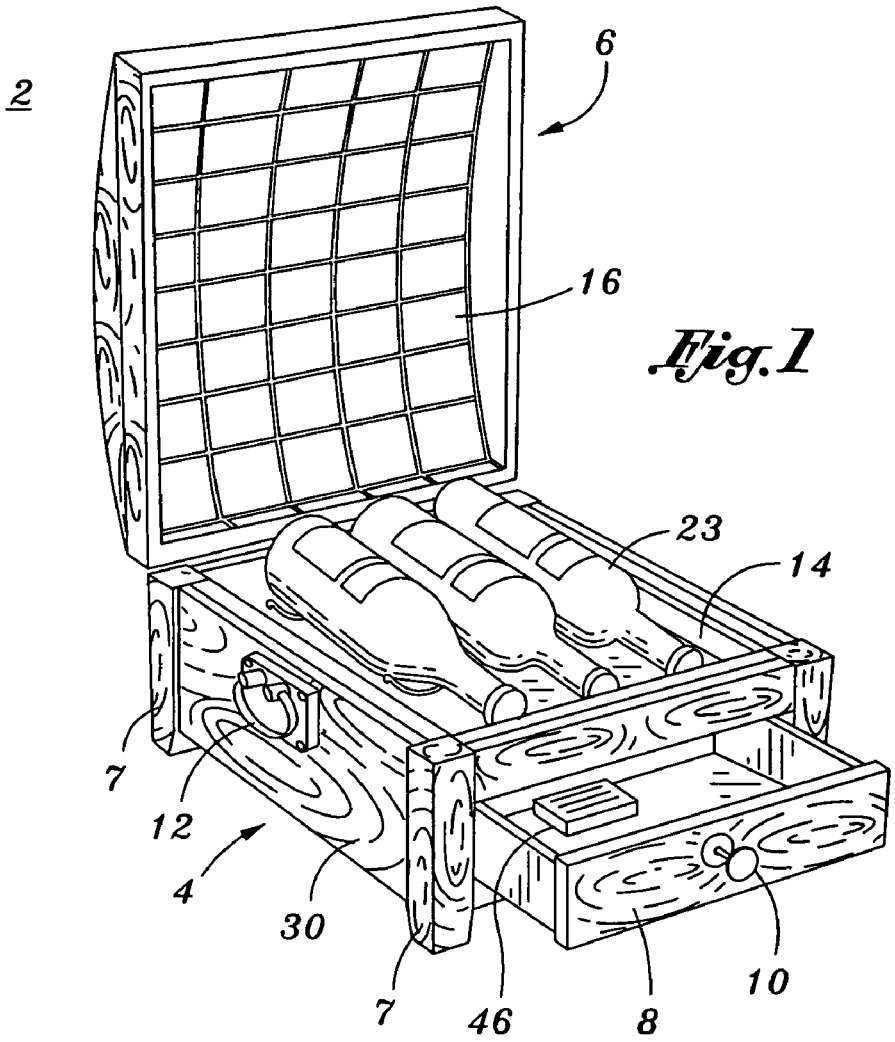
FIG. 1 shows an upper front perspective view of an exemplary compact wine cooler and humidor with the lid open, according to an aspect of the present invention.
Figure 2:
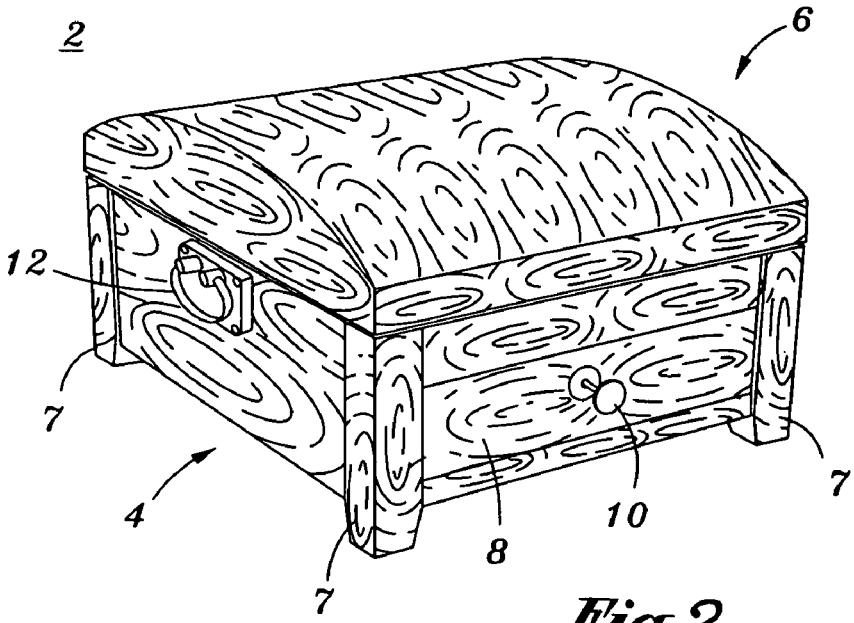
FIG. 2 shows an upper front perspective view of the exemplary wine cooler and humidor with the lid shut, according to an aspect of the present invention.

FIG. 1 shows an upper front perspective view of the exemplary compact wine cooler and humidor 2, which includes a base 4 with a lid 6 hingedly attached to the base 4 in an open position, according to an aspect of the present invention. While FIG. 2 shows an upper front perspective view of the exemplary wine cooler and humidor 2 with the lid 6 closed, according to an aspect of the present invention.

The structure of the cooler and humidor 2 is a small cabinet designed to resemble a cigar humidor or small chest. Preferably, the structure is made from wood and is built utilizing known carpentry techniques. The preferred embodiment is configured to store three normal sized bottles of wine 23 side-by-side in a horizontal storage orientation. However, it is recognized that the present invention may also be configured to hold as little as one single bottle 23 or any plurality of bottles 23. Another feature of the present invention is a sliding drawer feature 8 which is may be used for storing accessories, such as corkscrews, cutters, wine-keys and humidifier devices 46. Other features of the wine cooler and humidor 2 include a bottle tray 14 adapted to hold the bottles of wine 23 and a lid interior panel 16 which is inserted into the underside of the lid 6. Also, other functional features of the present invention include handles 12 which may be mounted to the sides 30 of the base 4 of the cabinet, and a knob 10 that may be mounted onto the frontside of the drawer 8.

Figure 3:
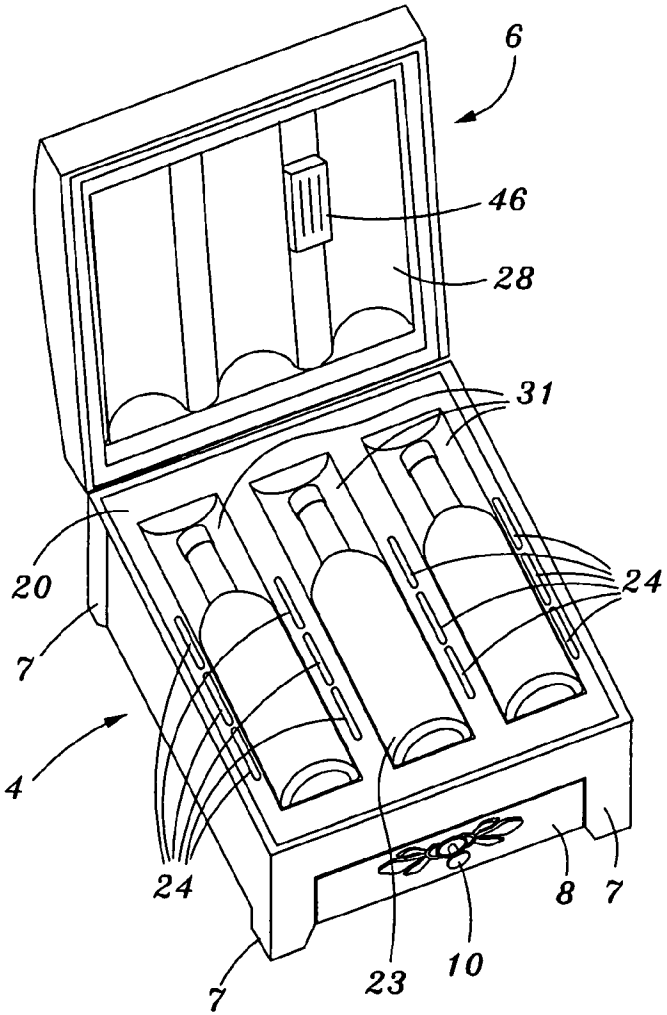
FIG. 3 shows an exemplary embodiment of a tray insert with bottle receiving recesses and a plurality of longitudinal circulation slots disposed through the tray next to the recesses, according to an aspect of the present invention.

FIG. 3 shows an upper front perspective view of an exemplary wine cooler and humidor 2 with the lid 6 open, and in particular, FIG. 3 shows an exemplary embodiment of a bottle tray 20 with a plurality longitudinal circulation slots 24, according to an aspect of the present invention. The bottle tray 20 is designed to accomplish several functions. First and foremost, the bottle tray 20 has a plurality of semicircular recesses 31 disposed on the upper surface thereof for receiving the wine bottles 23. Secondly, the bottle tray insert 20 includes a plurality of longitudinal circulation slots 24 disposed through the bottle tray 20 for allowing air to circulate within the entire wine cabinet 2. Finally, the bottle tray 20 may function as a cold pan 29 (see FIGS. 6 and 7). The function of the cold pan structure 29 will be described in greater detail with respect to the cooling system later in the specification. Also, as shown in FIG. 3, a humidifier device 46 may be attached to the lid interior panel 16.

Figure 4:
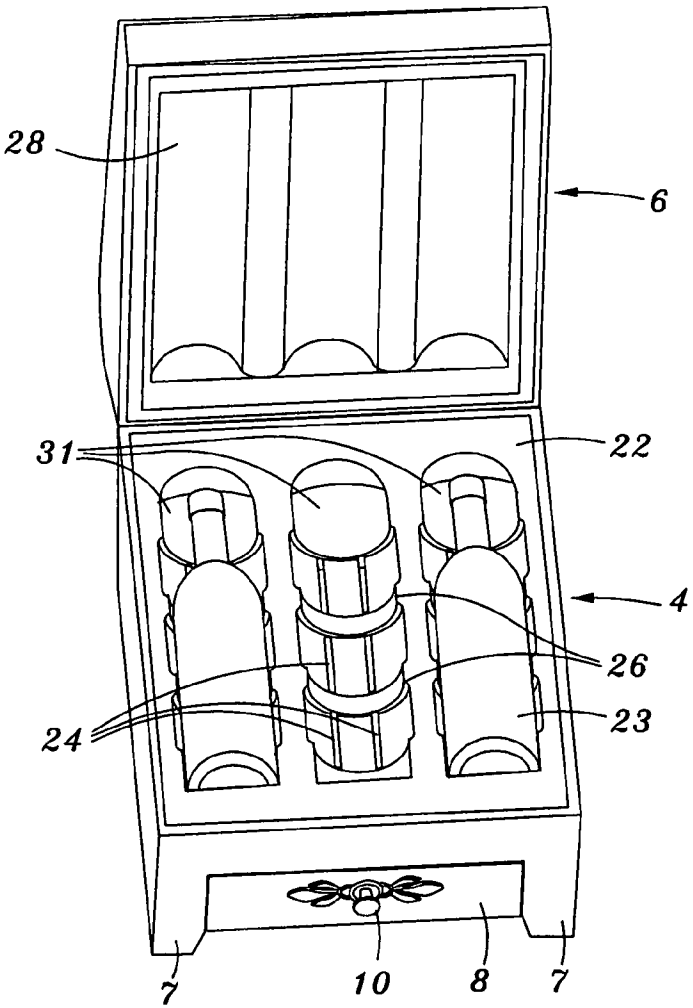
FIG. 4 shows another exemplary embodiment of a tray insert with a plurality of longitudinal circulation slots disposed within the bottle receiving recesses, according to an aspect of the present invention.

FIG. 4 shows another exemplary embodiment of a bottle tray 22 with a plurality of longitudinal circulation slots 24 formed within the semi-circular storage recesses 31, according to an aspect of the present invention. The bottle tray 22 is designed to accomplish the same functions as the bottle tray 20. In this particular embodiment, however, the semicircular recesses 31 include the longitudinal circulation slots 24. Furthermore, a plurality of protruding concentric ribs 26 may be formed in the recesses 31, wherein the ribs 26 are adapted for holding the wine bottles 23. Thus, the circulation slots 22 for bottle tray 22 are positioned underneath the bottles 23 to produce circulation around the bottle 23.

Exemplary Thermoelectric Components

Figure 5:
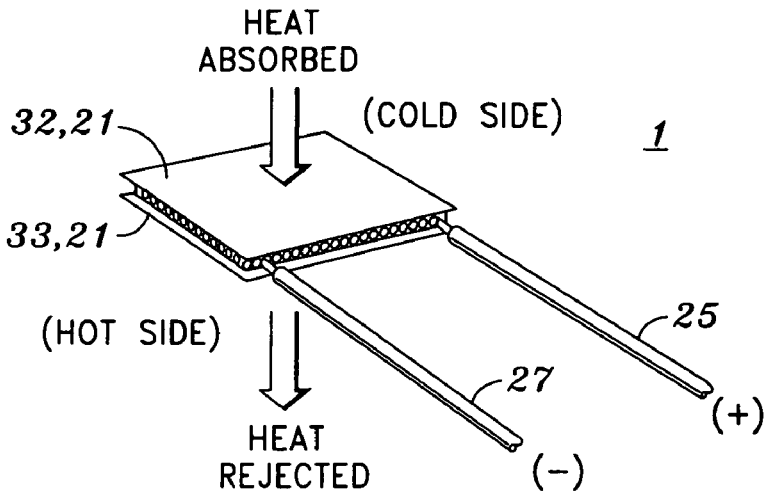
FIG. 5 shows a perspective view of an exemplary thermoelectric module, according to an aspect of the present invention.
Figure 6:
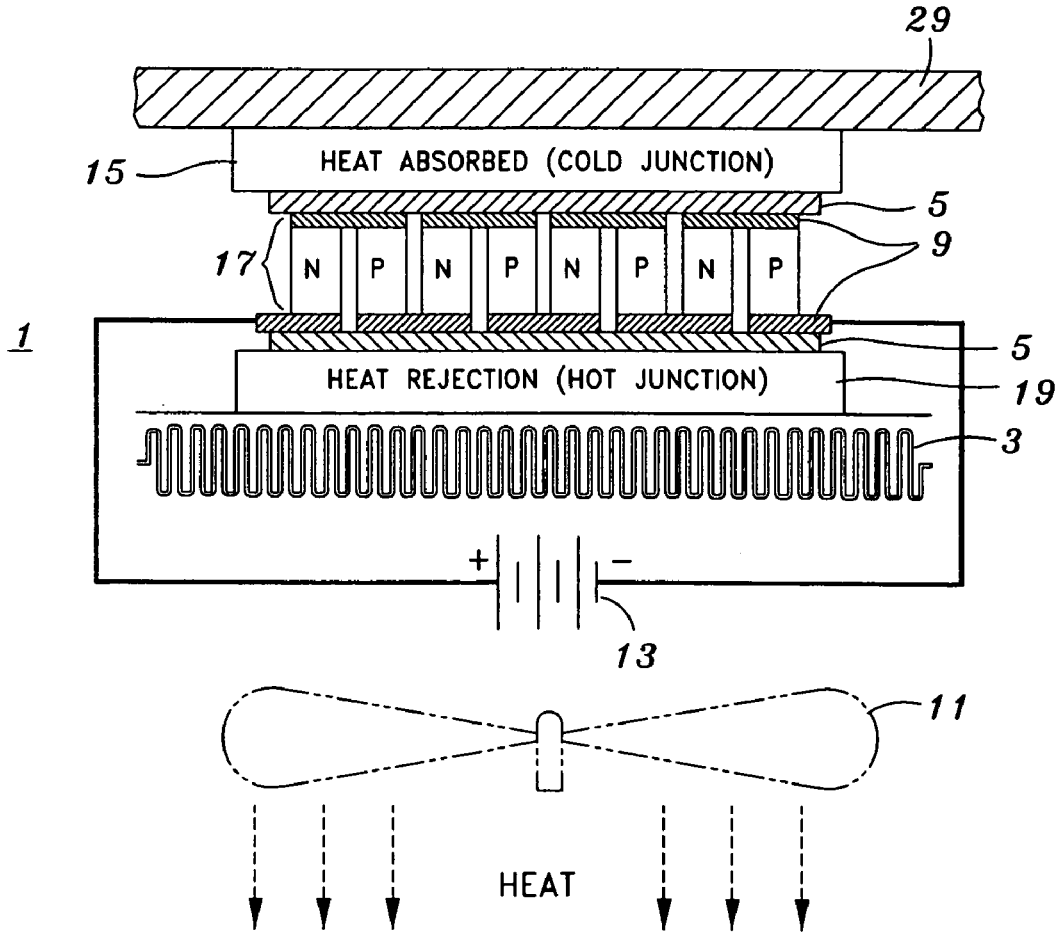
FIG. 6 shows a cross-sectional diagram of a thermoelectric module attached to a structure that absorbs heat and a heat sink and fan which dissipates heat, according to an aspect of the present invention.

FIGS. 5 and 6 show an exemplary a solid-state thermoelectric (TE) module 1 which is preferably utilized as the heart of the cooling system utilized within the present invention. Such modules 1 are capable of transferring large quantities of heat when connected to a heat absorbing device 29 on one side and a heat dissipating device 3 on the other.

FIG. 5 shows a perspective view of an exemplary thermoelectric module 1 which may utilized in the cooling system, according to an aspect of the present invention. As can be seen by FIG. 5, the thermoelectric couple 1 is very slim and compact. T.E. modules 1 are available in a great variety of sizes, shapes, operating currents, operating voltages and ranges of heat pumping capacity. The present invention may utilize one or more T.E. modules 1 as required to meet specific cooling requirements. In this embodiment of the T.E. module 1, the cold and hot junctions are ceramic substrates 21. As shown in FIG. 5, heat is absorbed from the cold side 32 and rejected from the hot side 33. Also shown, are the positive lead 25 and ground 27. The following paragraph explains how the T.E. modules 1 work.

FIG. 6 shows a cross-sectional diagram of a thermoelectric module 1, according to an aspect of the present invention. The T.E. module 1 includes a plurality of electronic carriers 17 comprising pairs of "N" type and "P" type semiconductors, sandwiched between a cold junction 15 and hot junction 19. The cold junction 15 is typically affixed to a structure 29 which acts as a cold plate which is adapted to absorb unwanted heat. On the other side of the cold junction 15, an electrical insulator 5 is affixed which acts as a heat conductor. On the other side of the electrical insulator 5, electrical conductors 9 are used to attach a respect pair of electronic carriers 17 such that an electrical circuit may be maintained. The other ends of the electronic carriers 17 are attached to the hot junction 19 in a similar manner, however, as noted, the electrical conductors 9 are arranged to connect different pairs of "P" and "N" semiconductor pairs to maintain the electrical circuit. That is to say, the "P" and "N" semiconductors are coupled in an offset manner to the hot junction 19, as compared to the cold junction 15. The most outboard electrical conductors 9 on the hot junction side 19, are then used as positive (+) and negative (−) connections to a 12 VDC electrical source. On the other side of the electrical conductors 9, is an electrical insulator 5 with the hot junction 19 attached thereto. And typically on the opposing side of the hot junction 19, a heat sink or radiator 3 may be attached. A circulating fan 11 can optionally be used to extract the heat from the heat sink 3 and to transfer, via circulation, the heat away from the heat sink 3.

As a result of the design of thermoelectric modules 1, they are considered to be heat pumps, i.e., solid-state devices without moving parts, fluids or gasses. Heat absorbed at the cold junction 15 is pumped to the hot junction 19 at a rate proportional to current passing through the circuit and the number of couples. Energy (heat) is absorbed from the environment into the structure 27, such as a cold plate. The energy is then absorbed into the cold junction 15. At the cold junction 15, energy (heat) is absorbed by electrons as they pass from a low energy level in the p-type semiconductor element, to a higher energy level in the n-type semiconductor element. The DC power supply 13 provides the energy to move the electrons through the circuit. At the hot junction 19, energy is expelled to a heat sink 3 as electrons move from a high energy level element (n-type) to a lower energy level element (p-type). Additionally, depending on the installation, a circulation fan 11 may be utilized to circulate heat away from the hot junction 19.

An Exemplary Electrical and Cooling System

Figure 7:
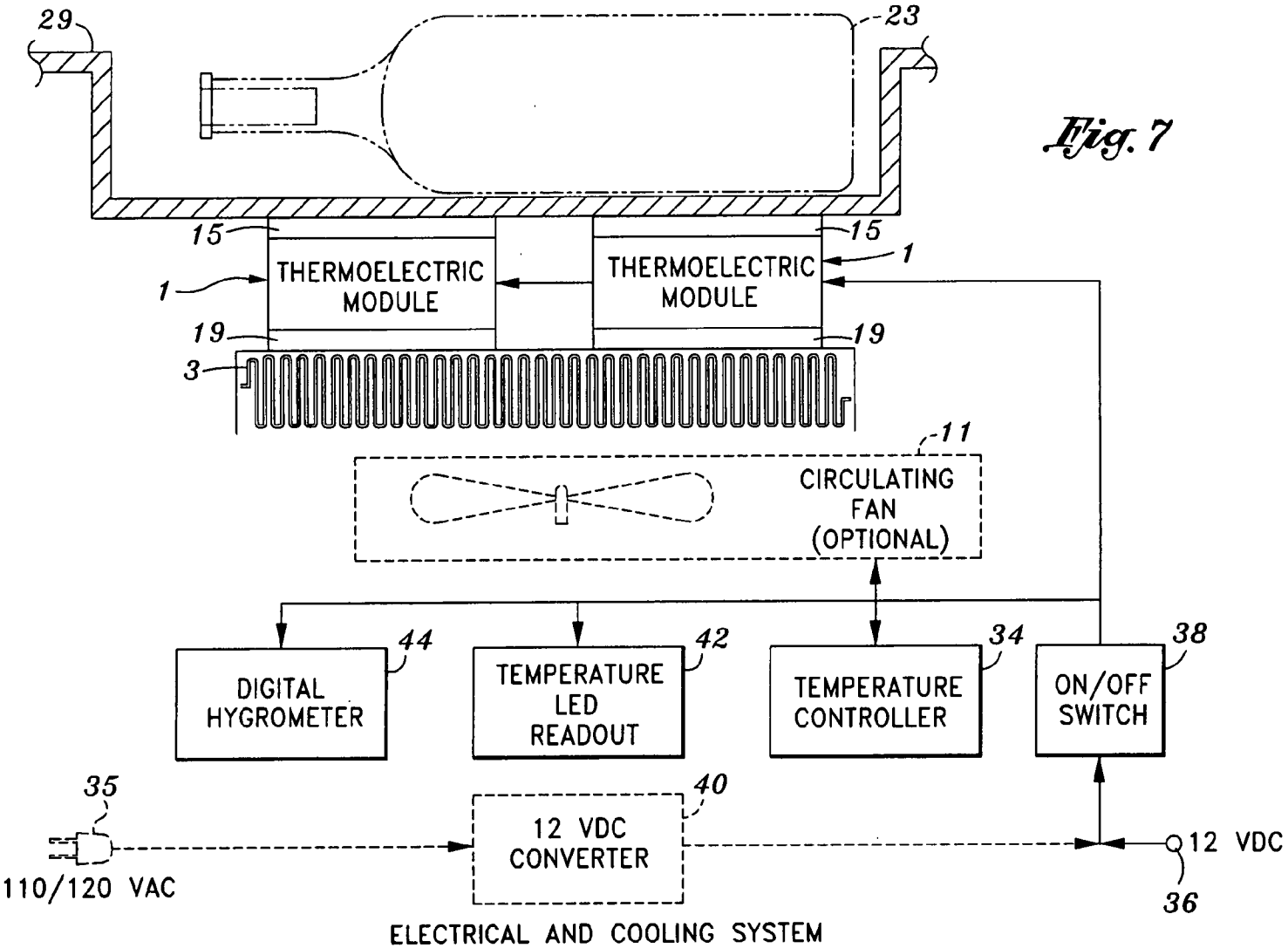
FIG. 7 provides an exemplary electrical and cooling schematic depicting various components within the present invention wine cooler and humidor, according to an aspect of the present invention.

FIG. 7 provides a schematic depicting various electrical and cooling components within the exemplary wine cooler and humidor 2, according to an aspect of the present invention. The wine cooler and humidor 2 may be powered by either 110/120 VAC or 12 VDC electrical power. Since the thermoelectric couples 1 are configured to be powered by 12 VDC, a 12 VDC converter 40 may be included in the device to convert the 110/120 VAC electricity to 12 VDC. It is also noted that since the system operates on 12 VDC, that the present invention is ideally suited for RV's, yachts or any other vehicle or system that utilizes 12 VDC. For example, the present invention may be operated from a standard electrical outlet or from the cigarette lighter of most vehicles. In another embodiment, the electrical plug 35 for the 110/120 VAC and 12VDC adapter/converter 40 may be external from the device 2. The electrical system is very efficient, drawing only 1 amp with 110 VAC and about 4.5 amps with 12 VDC. The electrical system may also include an ON/OFF switch 38, a temperature controller 34, a digital temperature readout 42, and digital hygrometer read out 44.

FIG. 7 further shows a plurality of T.E. modules 1 attached to the bottom of structure 29 which may be the bottle tray 14, 20, 22. I.E., since the heat from the bottles 23 and the upper compartment of the cabinet is desired to be removed, the cold junction 15 of the T.E. module 1 may be attached directly to the structure 29 which acts as a cold plate which is intended to absorb unwanted heat from the bottles and upper compartment of the cabinet. On the other side of the T.E. module 1, a heat sink 3 may be attached directly to the hot junction 19. Although not necessarily required in all applications of the present invention, on optional circulating fan 11 may be utilized to extract heat from the heat sink 3 and to eject the heat from the cabinet through optional vents located on either the bottom or backside of the cabinet base 4. Additionally, as noted earlier in the specification, the bottle trays 14 may include a plurality of longitudinal circulation slots 24 to enhance circulation and removal of heat from the upper compartment of the wine cooler and humidor 2.

Humidifier Features

As discussed previously, one aspect of the present invention is that even though its main purpose is to maintain wine at a constant cool temperature, the present invention also may be optionally adapted to function as a humidor, providing sufficient moisture to maintain as desired humidity level within the cabinet. One of the keys to providing a wine storage device which not only functions as a cooling device for beverages, but also functions as a humidor, is the material of which the cabinet is constructed. In particular, it is well-proven that building humidors from wood is particularly well suited for passively controlling humidity levels. Maintaining the targeted humidity range is a balancing act that depends in large part on the wood that is utilized and the tightness of the lid's 6 seal. The wood chosen to construct the present invention should not have an unpleasant smell or taste because the cork of the wine bottle 23 may absorb it. The wood also should be porous so it will first absorb, then release moisture evenly, while remaining dimensionally stable. Preferably, Spanish Cedar is the best choice of wood to construct the cabinet for the wine cooler and humidor 2. When kiln dried, it is very stable and will not warp or expand much when it reaches 70% moisture content. Furthermore, Spanish Cedar's oils inhibit the growth of molds and mildew that destroy corks and labels.

Preferably Spanish Cedar may be used for the sides 30 and the lid 6 of the cabinet. Birch plywood without any veneering is preferably utilized for the bottom of the cabinet Before fitting the bottle tray 14 in to the base 4, preferably a coat of flat lacquer is sprayed on the inside of the cabinet, except along the top and bottom edges. It is believed the lacquer slows down the release of moisture when the wine bottles 23 are stored within it. For aesthetic purposes, any veneering may be applied to the outside of the cabinet. Preferably, the cabinet is finished with several coats of lacquer. It is believed the combination of the stability of the Spanish Cedar, solid box construction, constant humidity on the inside, and the lacquer finish on the outside provides the best results.

The wine cooler and humidifier 2 may also include a humidifier device 46 (See FIGS. 1 and 3) which provides a source of moisture in the cabinet. Such a humidifier device 46 is extremely simple. A sponge-like material, often florist's foam or urethane foam pad, is contained in a plastic or metal vented case (e.g., anodized aluminum or stainless steel). Because moisture from the humidifier falls, it is preferred that the humidifier is attached underneath the lid 6 on the lid interior panel 16 for the most even distribution. However, the humidifier device 46 may also be stored inside the sliding drawer 8 if desired for simplicity of installation and for aesthetic reasons.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed; rather, the invention extends to all functionally equivalent structures, methods, and such uses are within the scope of the appended claims.

What is claimed is:

1. A wine cooler and humidor comprising:

a rectangular cabinet comprising, a base including four vertically oriented sidewalls, four vertically oriented legs, and a horizontally oriented bottom side, wherein the legs define four corners of the cabinet, each of the sidewalls are joined between a pair of legs, and the bottom side is attached to lower edges of the four sidewalls and to sides of the legs and positioned above a supporting surface; and a lid hingedly attached to an upper portion of the base, the lid including four side edges and a topside;

a bottle tray having an upper and lower surface, the tray positioned within an upper area defined by the base in a generally horizontal manner, the bottle tray including, a first plurality of generally semicircular recesses formed in the tray, each of which are adapted to receive a wine bottle, the recesses being positioned laterally next to each other, and a plurality of longitudinal circulation slots disposed through the bottle tray, wherein the plurality of slots are adapted for assisting with air circulation within the wine cooler; and a thermoelectric cooling system comprising at least one thermoelectric couple, each thermoelectric couple having a cold and hot junction, wherein the cold junction is attached to the lower surface of the bottle tray and a first heat sink is attached to the hot junction, wherein the at least one thermoelectric couple is adapted to be powered by a 12 VDC source.

2. The wine cooler and humidor according to claim 1, wherein the bottle tray acts as a cold pan which functions as a second heat sink which absorbs heat desired to be expelled from the hot junction.

3. The wine cooler and humidor according to claim 1, further including at least one circulating fan for extracting heat from the first heat sink and directing the heat outside of the cabinet through a vent disposed through one of the sidewalls or the bottom side of the base.

4. The wine cooler and humidor according to claim 1, further including a 12 VDC converter for receiving 110 or 120 AC and converting the same to 12 VDC.

5. The wine cooler and humidor according to claim 1, further including a temperature controller for maintaining a desired temperature within the wine cooler.

6. The wine cooler and humidor according to claim 1, further including an ON/OFF switch.

7. The wine cooler and humidor according to claim 1, further including a digital temperature readout device.

8. The wine cooler and humidor according to claim 1, further including a digital hygrometer readout device.

9. The wine cooler and humidor according to claim 1, further including a sliding cabinet drawer adapted to be positioned within a lower area of the base in a generally horizontal storage arrangement, and wherein the drawer is adapted to be pulled out from a drawer opening disposed through a sidewall of the base.

10. The wine cooler and humidor according to claim 1, further including a humidifier device.

11. The wine cooler and humidor according to claim 1, wherein the cabinet is constructed from wood for absorbing and releasing humidity.

12. The wine cooler and humidor according to claim 1, wherein the bottle tray includes three recesses for receiving three regular sized wine bottles.

13. The wine cooler and humidor according to claim 12, wherein the longitudinal circulation slots are positioned one each side of the first plurality of semicircular recesses.

14. The wine cooler and humidor according to claim 12, wherein the longitudinal circulation slots are positioned within the first plurality of semicircular recesses.

15. The wine cooler and humidor according to claim 14, each one of the first plurality of semicircular recesses including a plurality of radially concentric ribs protruding upwardly from each recess, wherein the plurality of ribs are adapted for supporting a wine bottle.

16. The wine cooler and humidor according to claim 1, further including a pair of handles attached to a pair the sidewalls of the base which oppose each other.

17. The wine cooler and humidor according to claim 1, further including a lid interior panel disposed within an underside of the lid.

18. The wine cooler and humidor according to claim 17, the interior panel further including a second plurality of generally semicircular recesses formed in the lid which are adapted to receive a wine bottle when the lid is closed.

19. The wine cooler and humidor according to claim 1, wherein the topside of the lid has an arcuate convex shape.

* * * * *